US010792791B2

(12) United States Patent
Su

(10) Patent No.: US 10,792,791 B2
(45) Date of Patent: Oct. 6, 2020

(54) CLENCH WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 112 days.

(21) Appl. No.: 15/990,979

(22) Filed: May 29, 2018

(65) Prior Publication Data

US 2018/0272507 A1 Sep. 27, 2018

Related U.S. Application Data

(63) Continuation-in-part of application No. 15/387,824, filed on Dec. 22, 2016, now Pat. No. 10,286,526, which is a continuation-in-part of application No. 14/994,220, filed on Jan. 13, 2016, now Pat. No. 9,849,569.

(30) Foreign Application Priority Data

Mar. 18, 2015 (TW) ..... 104108634 A

(51) Int. Cl.

| | |
|---|---|
| ***B25B 13/46*** | (2006.01) |
| ***B25B 13/06*** | (2006.01) |
| ***B25B 23/00*** | (2006.01) |
| ***B25B 23/10*** | (2006.01) |

(52) U.S. Cl.

CPC ..... *B25B 13/468* (2013.01); *B25B 13/06* (2013.01); *B25B 13/463* (2013.01); *B25B 23/0057* (2013.01); *B25B 23/0071* (2013.01)

(58) Field of Classification Search

CPC ..... B25B 13/468; B25B 13/06; B25B 13/463; B25B 23/0057; B25B 23/0071

See application file for complete search history.

(56) References Cited

U.S. PATENT DOCUMENTS

| | | | |
|---|---|---|---|
| 145,399 | A | 12/1873 | Colbert |
| 221,299 | A | 11/1879 | Gray |

(Continued)

FOREIGN PATENT DOCUMENTS

| | | | |
|---|---|---|---|
| CN | 293566583 | U | 4/2014 |
| CN | 205497299 | U | 8/2016 |

(Continued)

*Primary Examiner* — Joseph J Hail
*Assistant Examiner* — J Stephen Taylor
(74) *Attorney, Agent, or Firm* — Alan D. Kamrath; Karin L. Williams; Mayer & Williams PC

(57) ABSTRACT

A clench wrench includes a structure including a handle and an engaging head. The engaging head includes an engaging space extending through front and back sides thereof. The engaging space defines an opening on both the front and back sides. A clenching device is mounted on the engaging head and includes a clenching member. The clenching member includes a clenching portion and is operable in a first mode in which the clenching portion is located at a first position and capable of clenching an object engaged with the engaging head, and a second mode in which the clenching portion is disposed away from the engaging space and is located at a second position and capable of letting the object engaged with the engaging head disengage therefrom.

13 Claims, 13 Drawing Sheets

(56) References Cited

U.S. PATENT DOCUMENTS

| | | | | |
|---|---|---|---|---|
| 625,149 | A | 5/1899 | Crocker | |
| 1,635,102 | A | 7/1927 | Watson | |
| 2,751,802 | A | 6/1956 | Reuillard | |
| 2,757,564 | A | 8/1956 | Reaves | |
| 4,993,725 | A | 2/1991 | Barnes | |
| 6,481,315 | B1 | 11/2002 | Chang et al. | |
| 6,516,689 | B1 | 2/2003 | Bates | |
| 6,752,046 | B1 | 6/2004 | Lee | |
| 6,871,570 | B1 * | 3/2005 | Santillan | B25B 13/461 81/125 |
| 6,889,581 | B2 * | 5/2005 | Chen | B25B 13/04 81/125 |
| 6,948,406 | B1 | 9/2005 | Li | |
| 7,188,552 | B1 * | 3/2007 | Koppenhoefer | B25B 13/06 81/125 |
| 7,243,816 | B2 * | 7/2007 | Aochi | B65D 25/2811 220/829 |
| 8,261,635 | B2 | 9/2012 | Lee et al. | |
| 8,535,323 | B2 | 9/2013 | Keefer et al. | |
| 9,156,141 | B2 | 10/2015 | Chang | |
| 9,205,538 | B2 | 12/2015 | Yang | |
| 9,308,631 | B2 | 4/2016 | Shyu | |
| 9,393,676 | B2 | 7/2016 | Weber | |
| 9,592,594 | B2 | 3/2017 | Chen | |
| 9,789,593 | B2 | 10/2017 | Kao | |
| 9,849,569 | B2 | 12/2017 | Su | |
| 10,166,659 | B2 | 1/2019 | Chou | |
| 10,173,306 | B2 | 1/2019 | Chou | |
| 2017/0100820 | A1 * | 4/2017 | Su | B25G 1/063 |
| 2018/0111253 | A1 * | 4/2018 | Chang | B25B 23/0035 |

FOREIGN PATENT DOCUMENTS

| | | | |
|---|---|---|---|
| DE | 887779 | B | 6/1954 |
| JP | H06226649 | A | 8/1994 |
| TW | 483359 | U | 4/2002 |
| TW | 547258 | U | 8/2003 |
| TW | 551251 | U | 9/2003 |
| TW | M452041 | U | 5/2013 |
| TW | 201330987 | A | 8/2013 |
| TW | M537002 | U | 2/2014 |
| TW | M476030 | U | 4/2014 |
| TW | M480447 | U | 6/2014 |
| TW | M489731 | U | 11/2014 |
| TW | M492226 | U | 12/2014 |
| TW | M494064 | U | 1/2015 |
| TW | M498090 | U | 4/2015 |
| TW | M518144 | U | 3/2016 |
| TW | I540023 | B | 7/2016 |
| TW | M536604 | U | 2/2017 |
| TW | M543144 | U | 6/2017 |
| TW | M555781 | U | 2/2018 |
| TW | I624332 | B | 5/2018 |
| TW | I634971 | B | 9/2018 |
| TW | I637817 | B | 10/2018 |
| TW | I637819 | B | 10/2018 |
| TW | I637820 | B | 10/2018 |

* cited by examiner

CLENCH WRENCH

CROSS REFERENCE TO RELATED APPLICATION

The present application is a continuation-in-part application of U.S. patent application Ser. No. 15/387,824 filed on Dec. 22, 2016.

BACKGROUND OF THE INVENTION

1. Field of the Invention

The present invention relates to a wrench and, particularly, to a clench wrench.

2. Description of the Related Art

TW Pat. No. M476030 teaches a ratcheting box wrench. The wrench includes a ratchet wheel and an engaging hole. The engaging hole is adapted to receive a socket or an object to be wrenched. The engaging hole is defined by an inner periphery of the ratchet wheel. The socket is prevented from disengaging from the wrench by a resilient C-clip. The C-clip can prevent the object to be wrenched from disengaging from the wrench. In order to receive the C-clip, a groove is defined on an outer periphery of the ratchet wheel and a plurality of openings extends through the inner and outer peripheries of the ratchet wheel. Thus, the C-clip is partially disposed in the hole and can abut an outer periphery of the socket.

The ratchet wheel has a complex design and has a high cost of manufacture. Furthermore, the C-clip can disengage from the ratchet wheel easily inadvertently when forcing the object to be wrenched to disengage from the hole and, it is difficult to reengage the C-clip with the ratchet wheel. Additionally, when the socket or the object is too slippery to grasp, a user often encounter difficulty to overcome C-clip's restraining force to disengage the socket or the object from the hole if the socket or object is too slippery to grasp.

The present invention is, therefore, intended to obviate or at least alleviate the problems encountered in the prior art.

SUMMARY OF THE INVENTION

According to the present invention, a clench wrench includes a structure including a first body defining a handle for a user to grasp and a second body defining an engaging head for engaging with an object to be clenched respectively. The engaging head includes an engaging space for receiving the object engaged with and to be driven by the clench wrench. The engaging head has two opposite sides with one side defining a front side and the other side defining a back side respectively and includes the engaging space extending through the front and back sides and defining an opening in each of the front and back sides. A clenching device is mounted on the engaging head and configured for clenching the object. The clenching device including a resilient clenching member connected with the engaging head. The clenching member includes a clenching portion and is operable in a first mode in which the clenching portion is located at a first position and capable of clenching the object received by the engaging space, and a second mode in which the clenching portion is disposed away from the engaging space and is located at a second position and capable of letting the object engaged with the engaging head disengage therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a clench wrench capable of preventing disengagement of an object engaged therewith from the clench wrench.

It is another objective of the present invention that the clench wrench selectively engages and disengages the object effortlessly.

Other objectives, advantages, and new features of the present invention will become apparent from the following detailed description of the invention when considered in conjunction with the accompanied drawings.

DETAILED DESCRIPTION OF THE INVENTION

Figure 1:
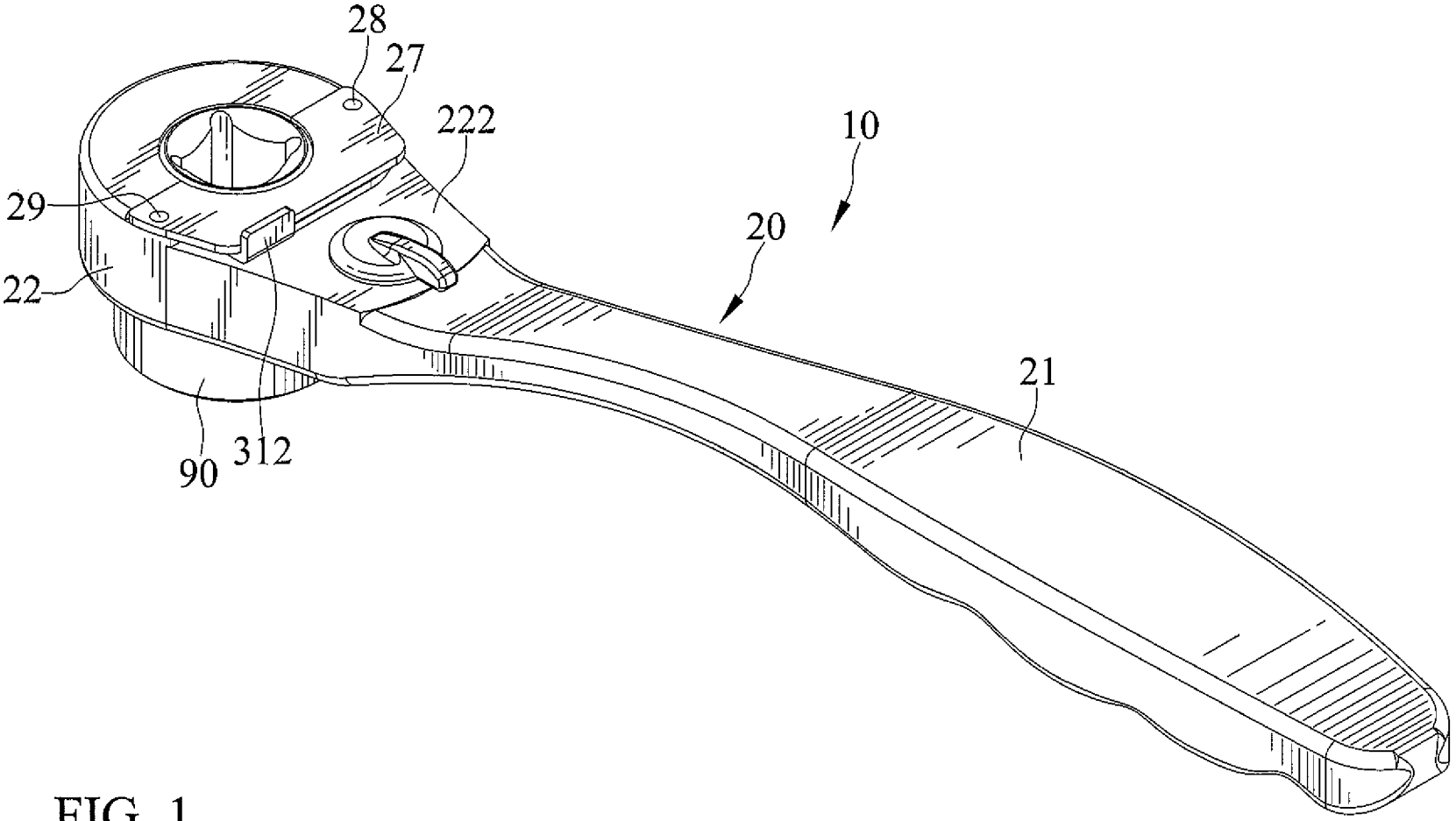
FIG. 1 is a perspective view of a clench wrench in accordance with a first embodiment of the present invention.
Figure 2:
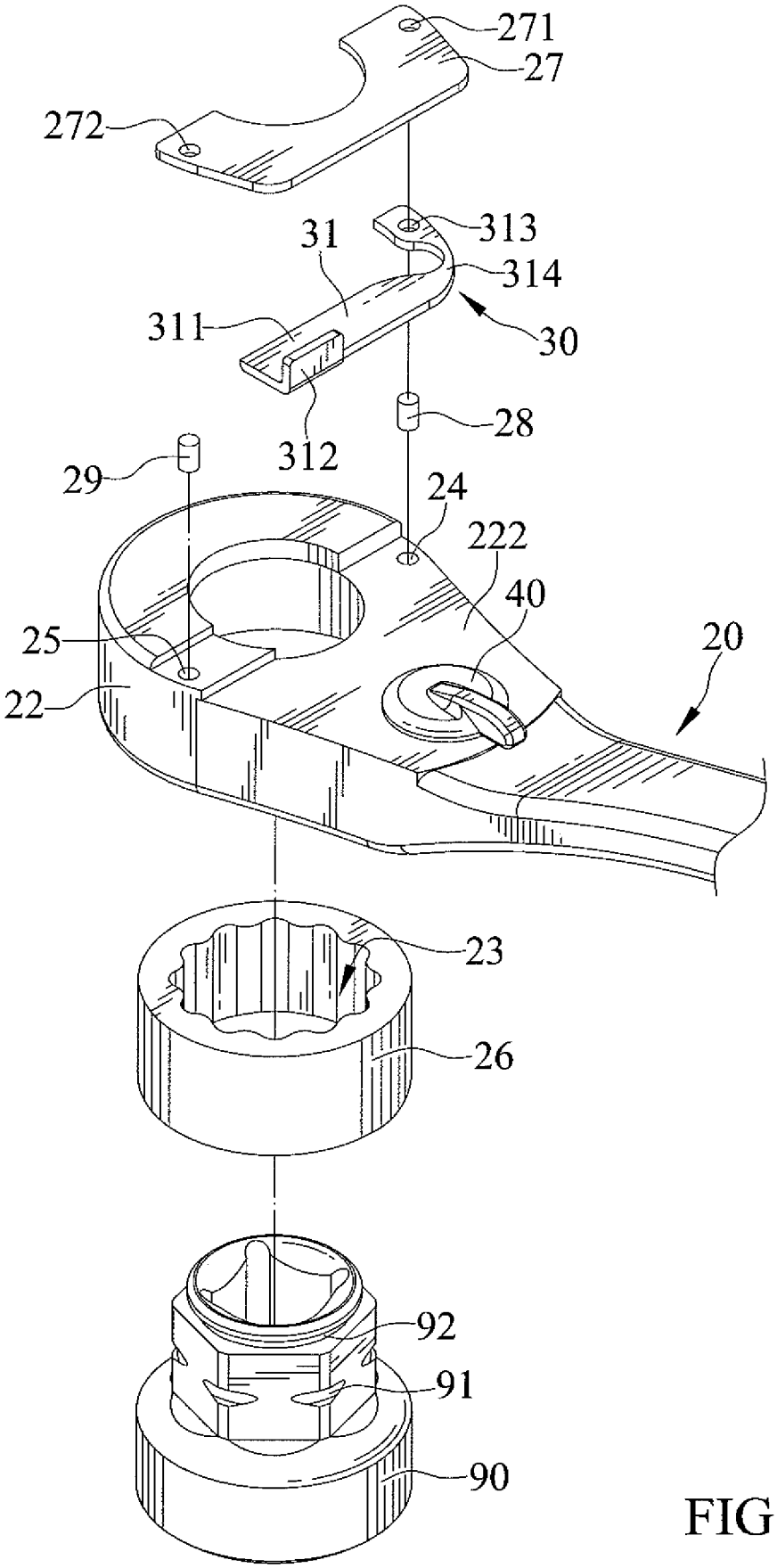
FIG. 2 is an exploded perspective view of the clench wrench of FIG. 1.
Figure 3:
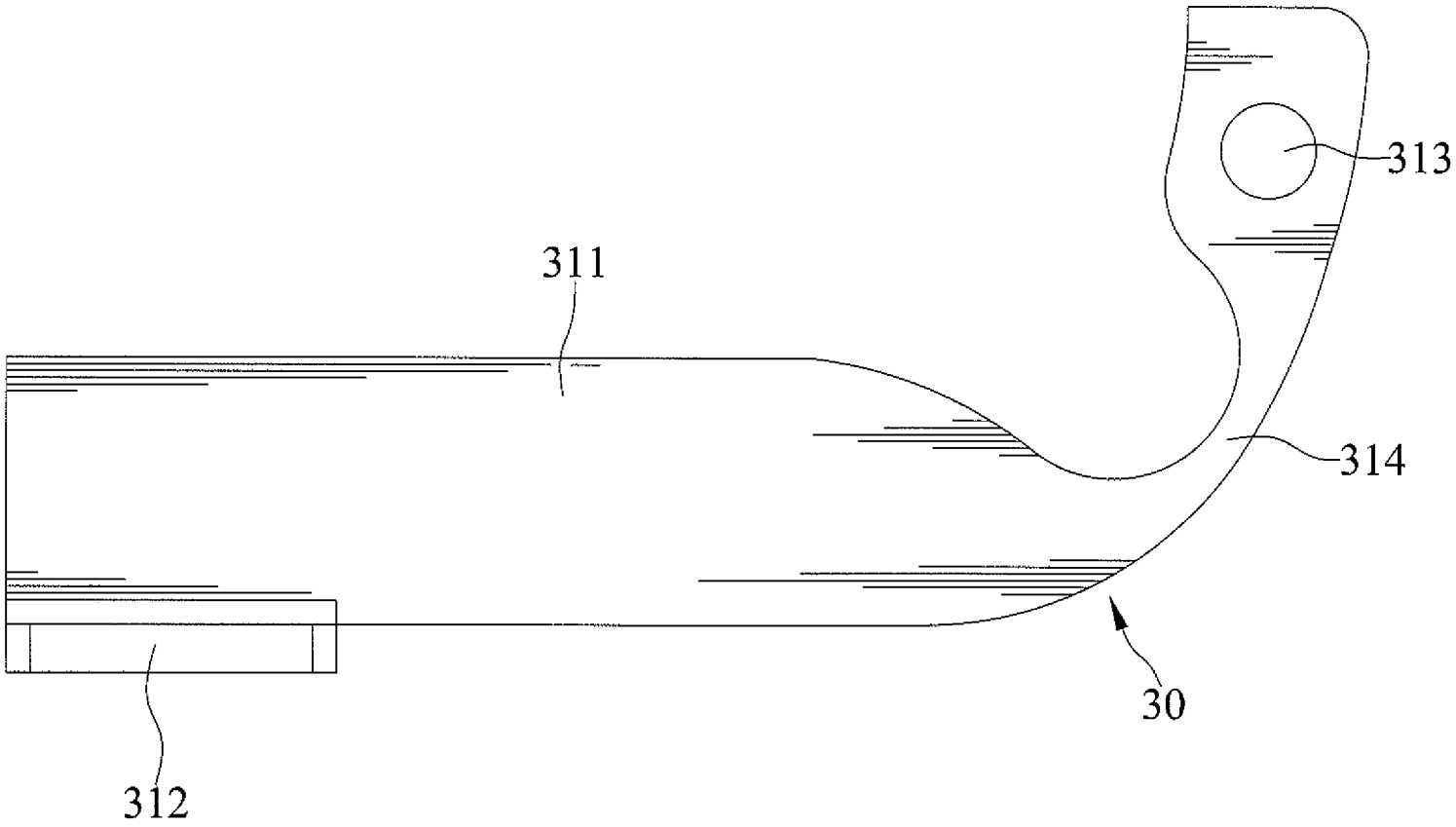
FIG. 3 is a side view of a clenching member of the clench wrench of FIG. 1.
Figure 4:
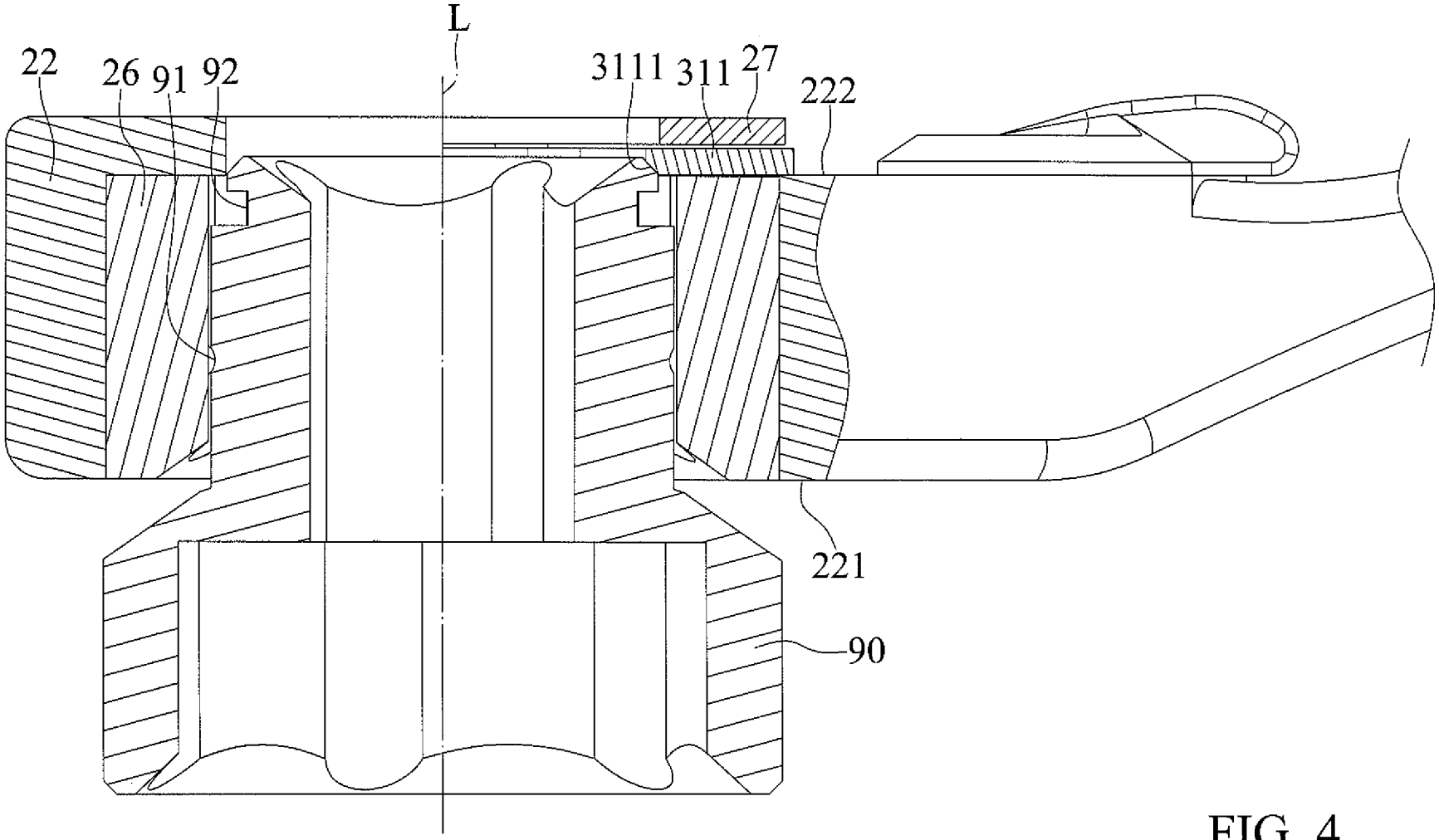
FIG. 4 is a cross-sectional view showing a socket inserted into an engaging space of the clench wrench of FIG. 1.
Figure 5:
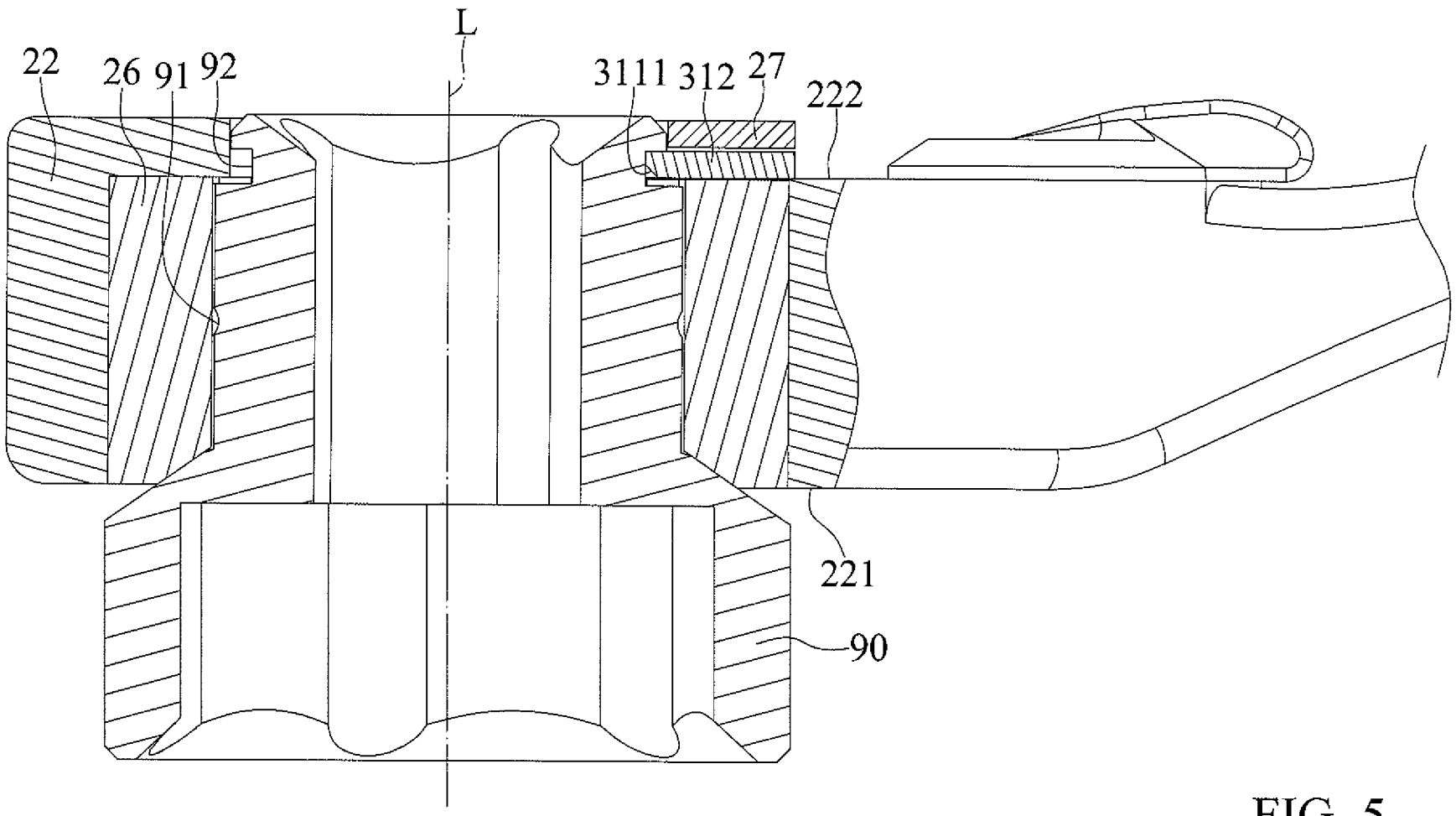
FIG. 5 is a cross-sectional view showing the clench wrench of FIG. 1 clenching and preventing the socket from disengaging therefrom.
Figure 6:
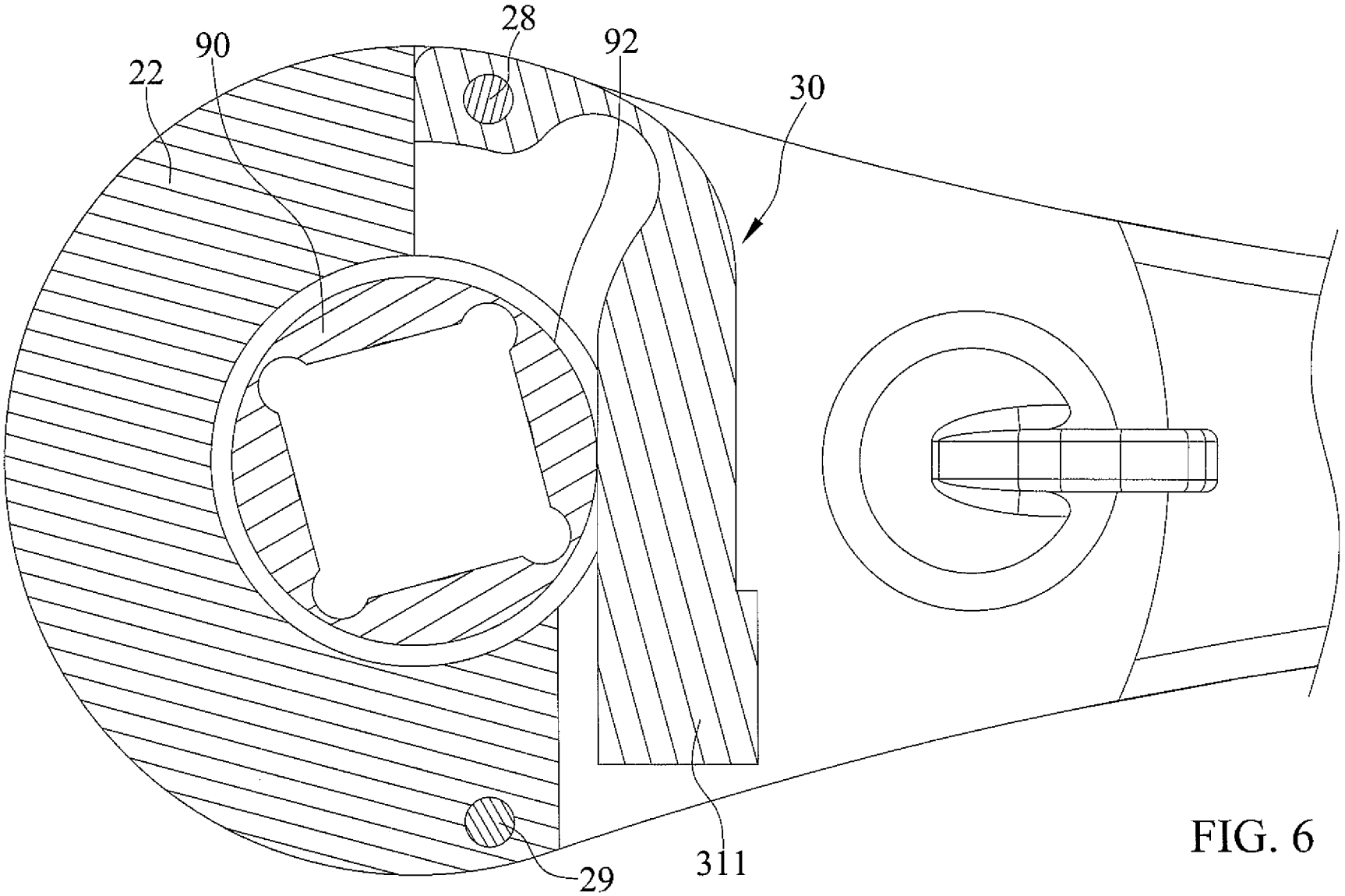
FIG. 6 is another cross-sectional view showing the clench wrench of FIG. 1 clenching the socket.

FIGS. 1 through 6 show a clench wrench 10 in accordance with a first embodiment of the present invention capable of preventing disengagement of an object engaged therewith from the clench wrench 10.

The clench wrench 10 has a structure 20 including a first body 21 and a second body 22. The first body 21 defines a handle for a user to grasp when operating the clench wrench 10. The second body 22 defines an engaging head for engaging with an object to be clenched. The second body 22 is integrated with the first body 21. In the embodiment, the first and second bodies 21 and 22 are defined from the one-piece structure 20, but not limited thereto. Alternatively, the first and second bodies 21 and 22 can be two separate elements and are integrated together.

The engaging head has two opposite sides with one side defining a front side 221 and the other side defining a back side 222 respectively. The distance between the front and back sides 221 and 222 defines the thickness of the engaging head. The engaging head includes an engaging space 23 for receiving the object to be driven by the clench wrench 10. The engaging space 23 extends through the front and back sides 221 and 222 and defines an opening in each of the front and back sides 221 and 222. The engaging space 23 is defined by an inner periphery of a ratchet wheel 26. The ratchet wheel 26 is rotatably engaged with the engaging head and has a center of rotation about an axis L. The axis L extends in the thickness direction of the engaging head. The inner periphery of the ratchet wheel 26 is polygonal and includes ridges formed by peripheral sides. The ridges can facilitate turning of the object by the clench wrench 10.

A clenching device 30 is mounted on the engaging head and configured to clench the object. The clenching device 30 includes a clenching member 31 connected with the engaging head. The clenching member 31 is disposed on one of the front and back sides 221 and 222. The clenching member 31 has one first end fixed to the engaging head and another end being a free end. The fixed end of the clenching member 31 and one of the front and back sides 221 and 222 of the engaging head respectively includes a hole 313 and a first engaging hole 24, and a first fastener 28 inserts into the hole 313 and the first engaging hole 24 and fastens the clenching member 31 on the engaging head. The clenching member 31 is a thin plate that has a substantially smaller thickness than the thickness of the engaging head. Therefore, the clenching device 30 is configured to avoid making the clench wrench 10 too thick or not compact. The clenching member 31 includes a middle portion 314 between the fixed end and the free end. The middle portion 314 and fixed and free ends, in a lateral direction, each have a cross-sectional area, and the cross-sectional area of the middle portion 314 is smaller than the cross-sectional areas of the respective fixed and free ends. The clenching member 31 is resilient. The clenching member 31 is a metallic member. The clenching member 31 includes a clenching portion and is operable in a first mode in which the clenching portion is located at a first position capable of clenching the object received by the engaging space 23, and a second mode in which the clenching portion is located at a second position and disposed away from the engaging space 23 and capable of letting the object engaged with the engaging head disengage therefrom. The clenching portion is located at the first position when the clenching member 31 is not operated. The clenching portion is located at the free end of the clenching member 31. The clenching portion has an outer edge forming a sloped guiding edge 3111, and the object inserting into the engaging space 23 movably abuts against the sloped guiding edge 3111. The sloped guiding edge 3111 has a lower end and an upper end and extends from the lower end to the upper end in a slanting direction that facilitates the insertion of the object into the engaging space 23. The insertion of the object into the engaging space 23 is, therefore, not impeded by the clenching member 31. The clenching member 31 has a main body 311 and includes a lever 312 protruding upwardly from the main body 311. The lever 312 facilitates the operation of the clenching member 31.

The engaging head includes a wall 27 disposed above and shielding the clenching member 31. The wall 27 includes a first engaging aperture 271, and a first fastener 28 inserts into the first engaging aperture 271 and fastens the wall 27 on the engaging head. One of the front and back sides 221 and 222 of the engaging head and the wall 27 respectively include a second engaging hole 25 and a second engaging aperture 272, and a second fastener 29 inserts in the second engaging hole 25 and second engaging aperture 272 and fastens the wall 27 on the engaging head.

A switch device 40 is interacted with the ratchet wheel 26 and is configured to releasably stop the ratchet wheel 26 from rotation. The switch device 40 includes an input control exposed from the engaging head. Therefore, a user of the clench wrench 10 can easily operate the switch device 40 through the input control. The input control has a thickness and the clenching member 31 has a thickness not greater than that of the input control. Therefore, the clenching device 30 is configured to avoid making the clench wrench 10 too thick or not compact.

In the drawings, the object is a socket 90, but not limited thereto. The socket 90 is engaged with the clench wrench 10 and is prevented from disengaging therefrom when the clench wrench 10 clenches the socket 90. The socket 90 includes a joining end configured to be insertable into the engaging space 23, at least one recess 91, and a groove 92 formed on the joining end and configured to be adapted to receive and catch the clenching portion and the guiding slope 3111. Consequently, the socket 90 is adapted to be restrained by clenching portion of the clenching member 31.

Figure 7:
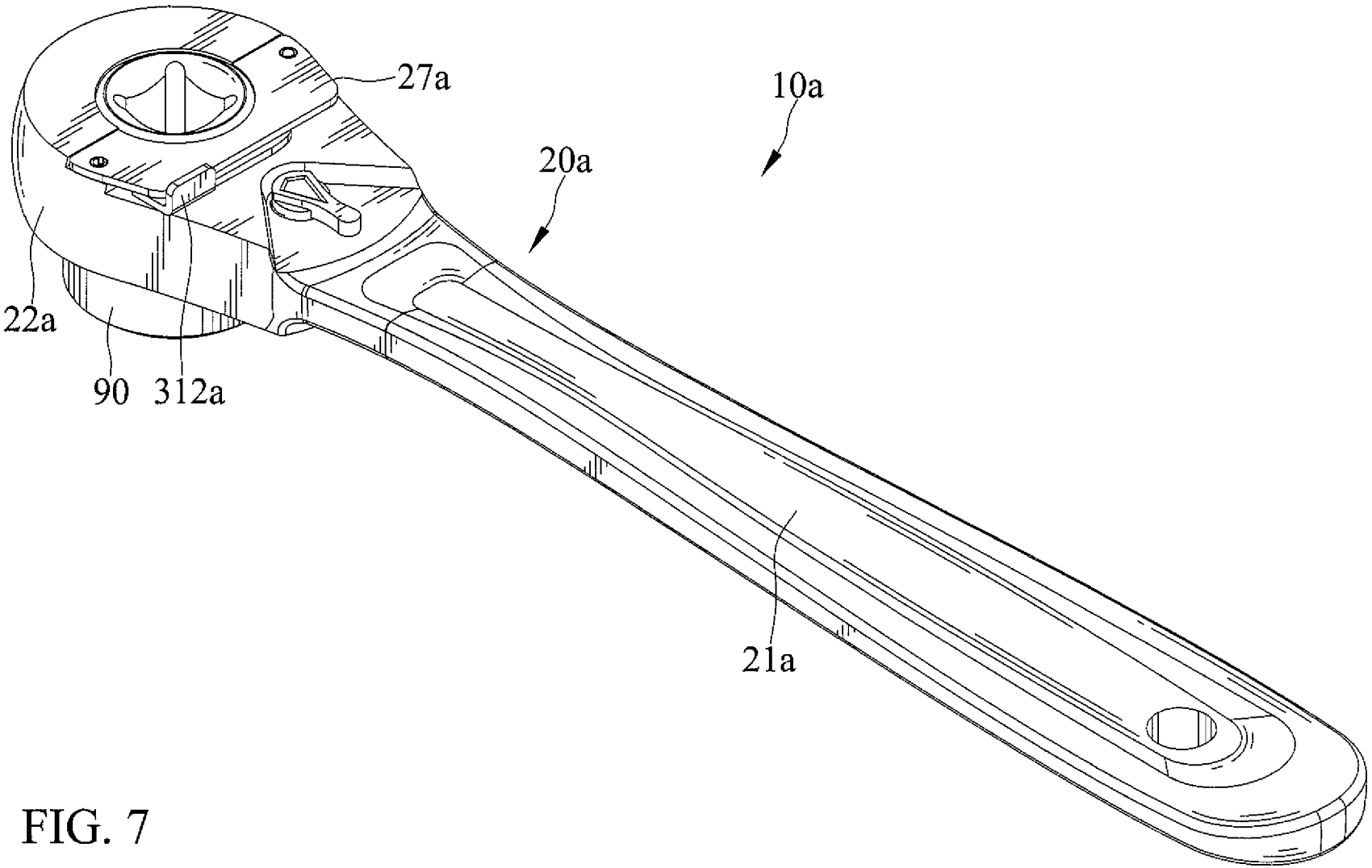
FIG. 7 is a perspective view of a clench wrench in accordance with a second embodiment of the present invention.
Figure 8:
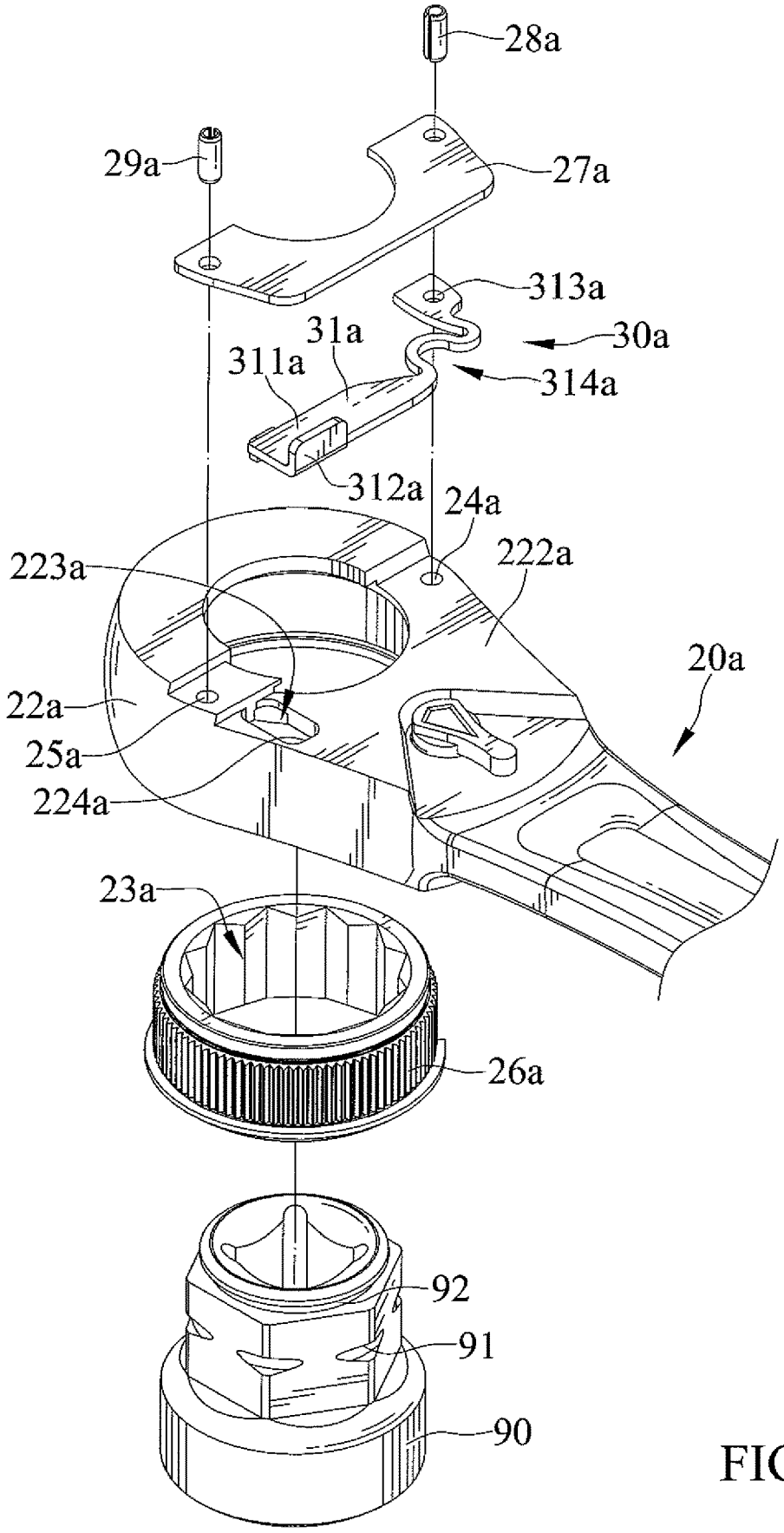
FIG. 8 is an exploded perspective view of the clench wrench of FIG. 7.
Figure 9:
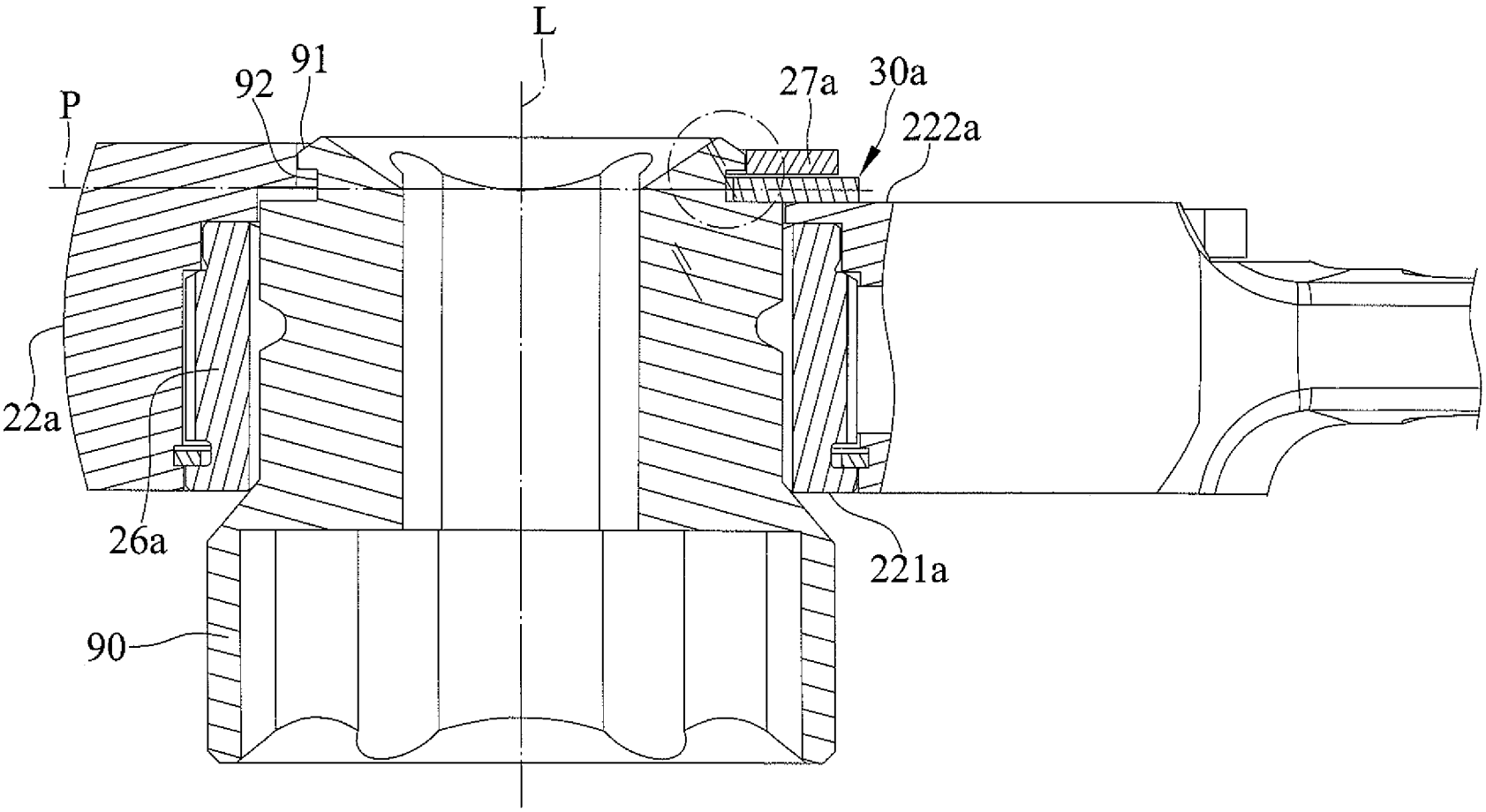
FIG. 9 is a cross-sectional view showing the clench wrench of FIG. 7 clenching and preventing the socket from disengaging therefrom.
Figure 10:
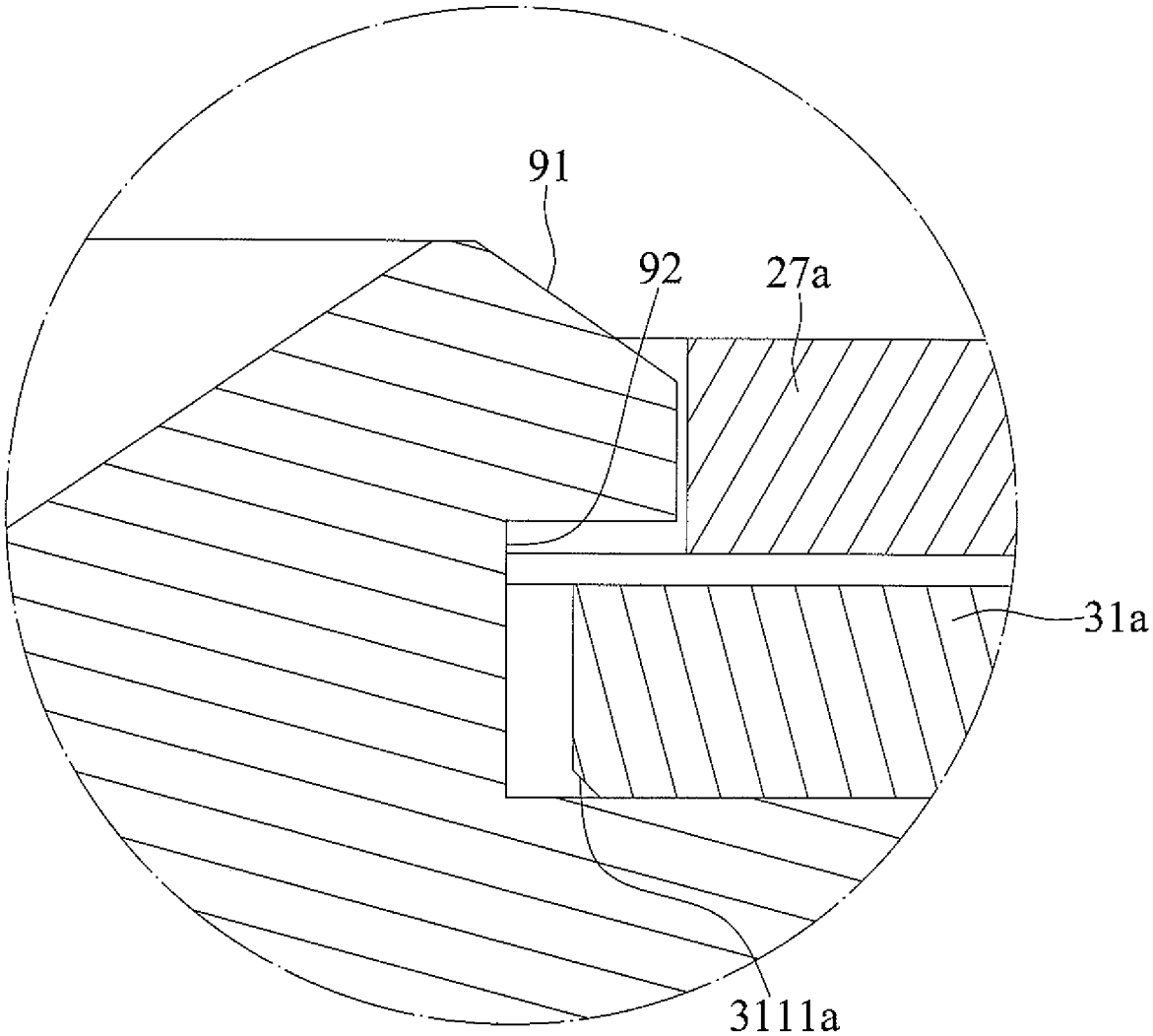
FIG. 10 is an enlarged view of a circled portion of FIG. 9.
Figure 11:
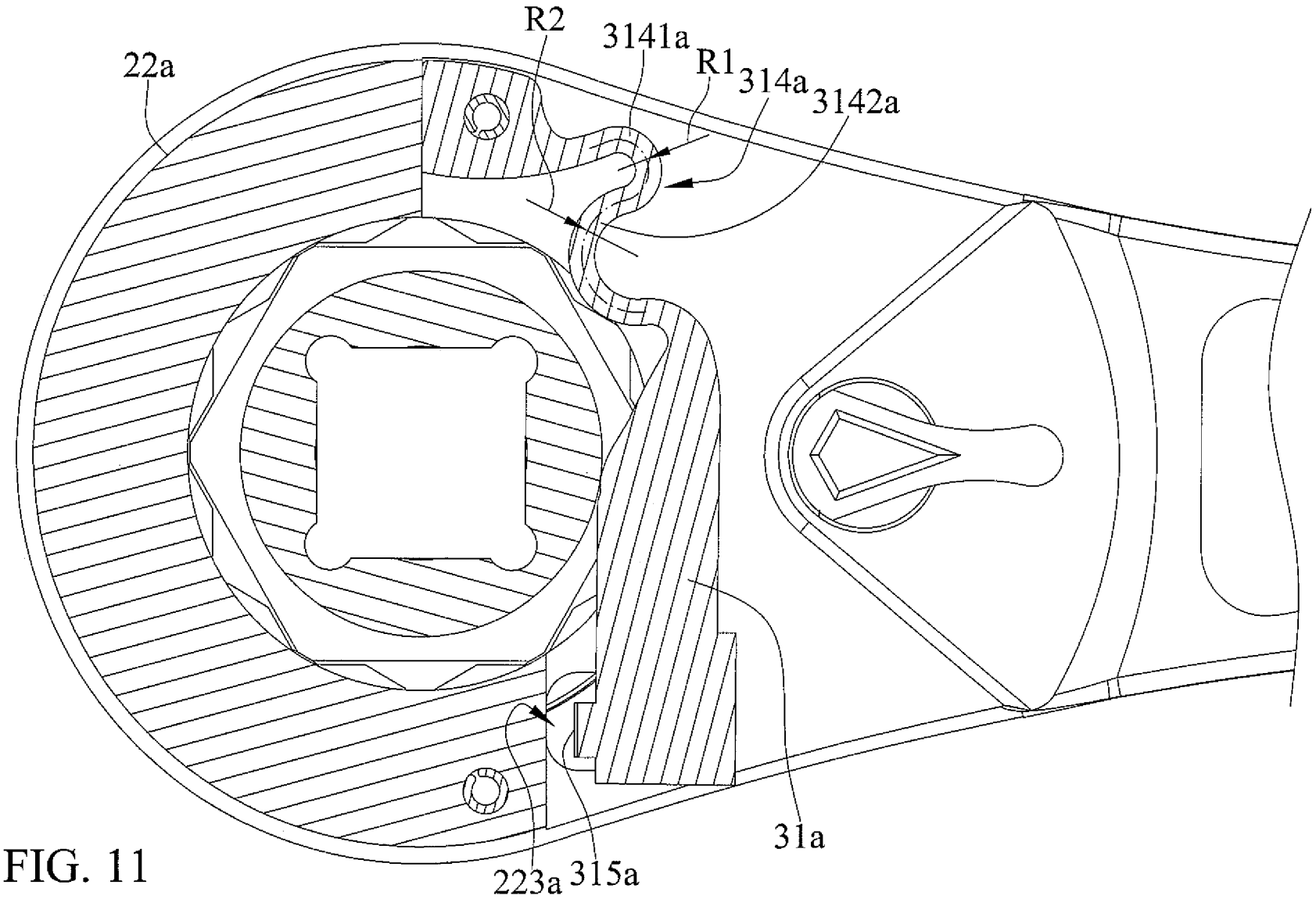
FIG. 11 is another cross-sectional view showing the clench wrench of FIG. 9 clenching the socket.
Figure 12:
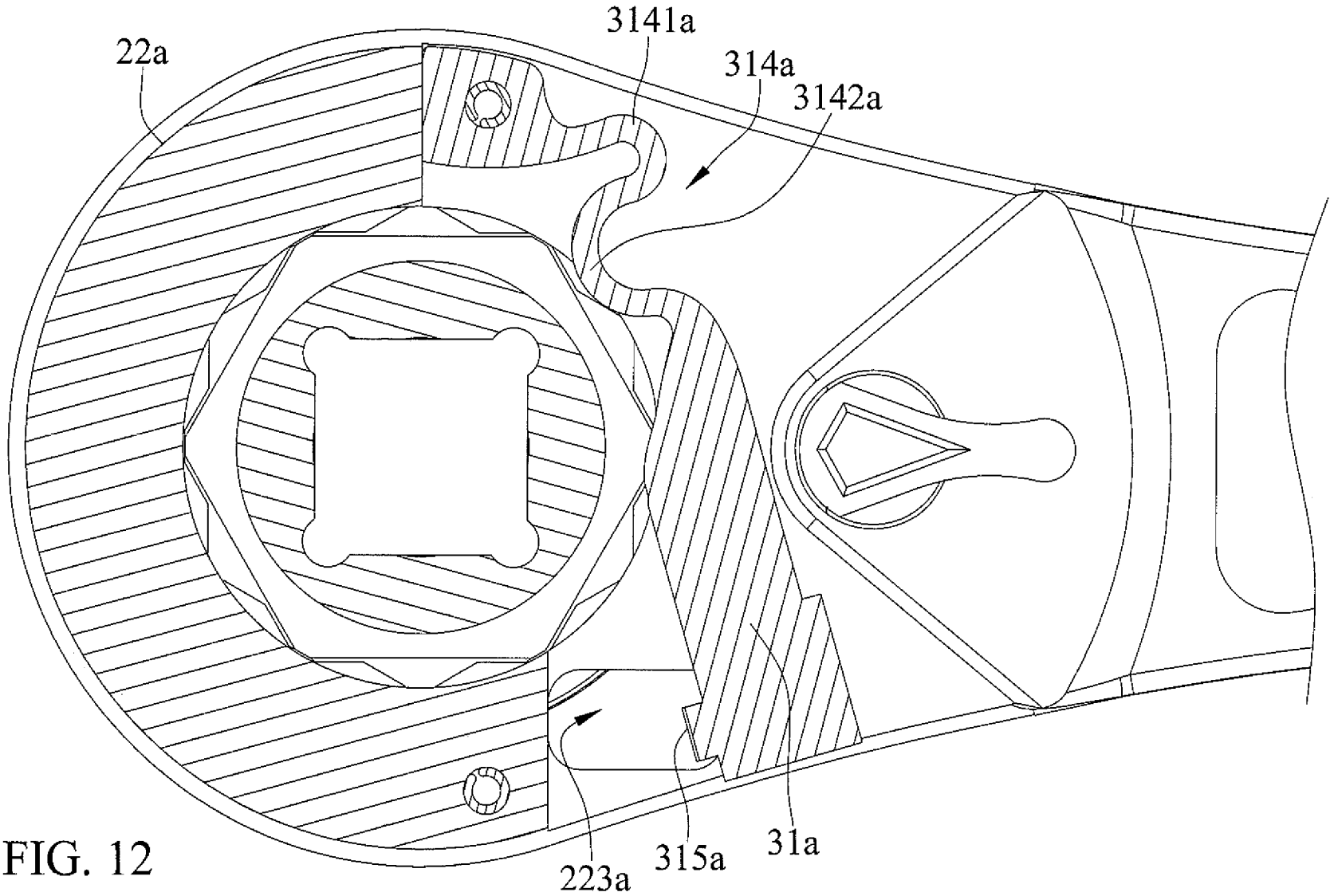
FIG. 12 is a cross-sectional view showing the clench wrench of FIG. 9 not clenching the socket.
Figure 13:
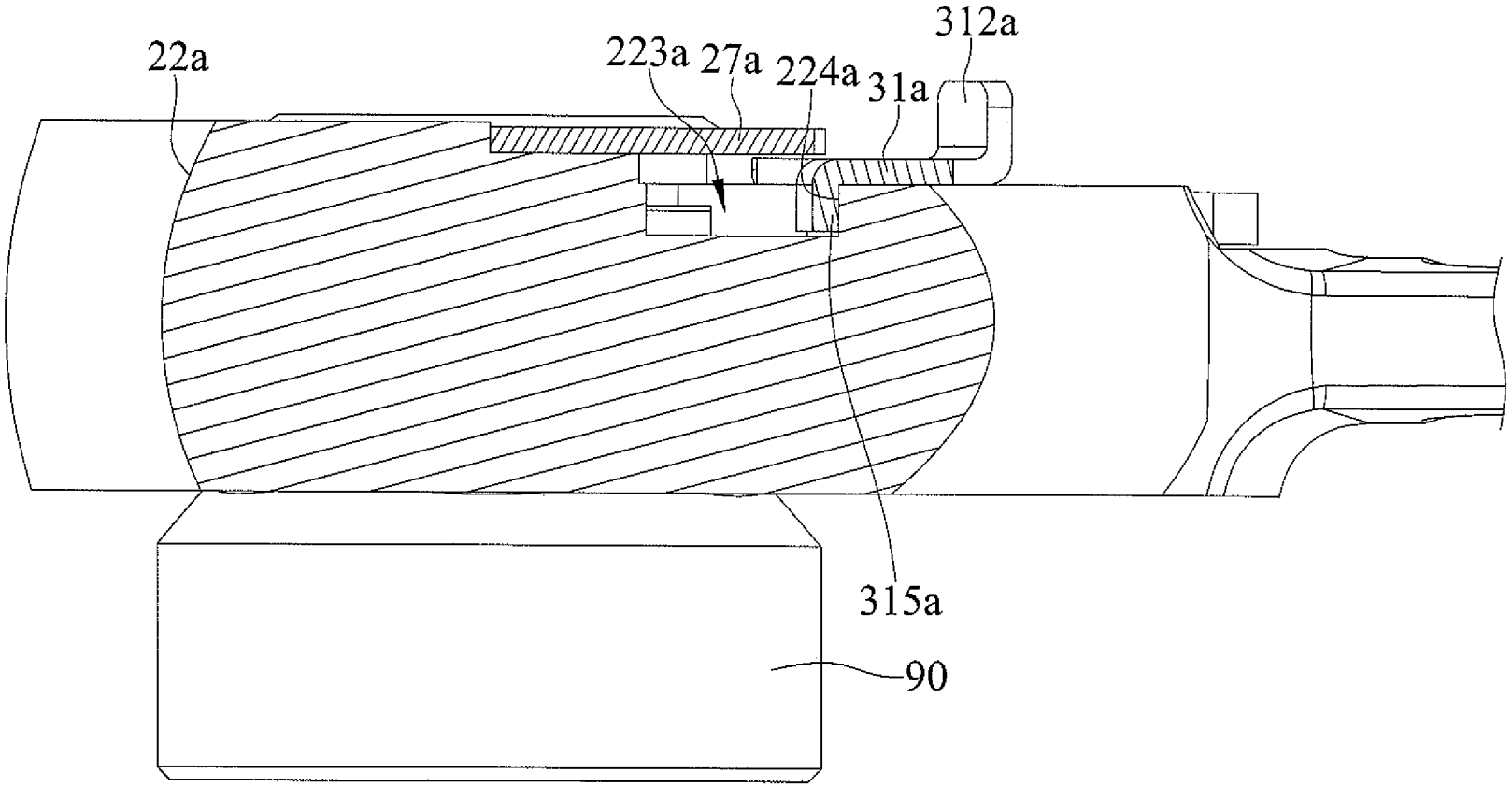
FIG. 13 is another cross-sectional view showing the clench wrench of FIG. 9 not clenching the socket.

FIGS. 7 through 13 show a clench wrench 10*a* in accordance with a first embodiment of the present invention capable of preventing disengagement of the object engaged therewith from the clench wrench 10*a*, and the same numbers are used to correlate similar components of the first embodiment, but bearing a letter b.

The clench wrench 10*a* includes a structure 20*a*. The structure 20*a* includes a first body 21*a* and a second body 22*a* connected to an end of the first body 21*a*. The first body 21*a* defines a handle for a user to grasp when operating the clench wrench 10*a*. The second body 22*a* defines an engaging head for engaging with the object to be clenched. The second body 22*a* includes a front side 221*a* and a back side 222*a* opposite to the front side 221*a* along an axis L. The structure 20*a* includes an engaging space 23*a* extending from the front side 221*a* through the back side 222*a* of the second body 22*a* along the axis L. The engaging space 23*a* of the structure 20*a* is configured to engage with the object and to drive the object to rotate about the axis L. The object is a socket 90, but not limited thereto. The engaging space 23*a* is defined by an inner periphery of a ratchet wheel 26*a*. The ratchet wheel 26*a* is rotatably engaged with the engaging head and has a center of rotation about the axis L. The axis L extends in the thickness direction of the engaging head. The inner periphery of the ratchet wheel 26*a* is polygonal and includes ridges formed by peripheral sides. The ridges can facilitate turning of the object by the clench wrench 10*a*. The structure 20*a* includes a wall 27*a* disposed on the back side 222*a* of the second body 22*a*. The wall 27*a* is fixed to the back side 222*a* of the structure 20*a* by a first fastener 28*a* and a second fastener 29*a*. Each of the first fastener 28*a* and the second fastener 29*a* extends in a direction parallel to the axis L. The back side 222*a* of the engaging head and the wall 27*a* respectively include an engaging hole 25*a* and an engaging aperture 272, and the second fastener 29 inserts in the second engaging hole 25 and second engaging aperture 272 and fastens the wall 27 on the engaging head. The engaging head includes the wall 27*a* disposed above and shielding a clenching member 31*a* of a clenching device 30 of the second embodiment. The structure 20*a* includes a limiting groove 223*a* in the back side 222*a* of the engaging head. A side of the limiting groove 223*a* includes a limiting portion 224*a*.

The clenching device 30*a* is mounted on the structure 20*a*. In this embodiment, the clenching device 30*a* is disposed on the back side 222*a* of the second body 22*a*. The clenching device 30*a* includes a clenching member 31*a*. The clenching member 31*a* has one first end fixed to the engaging head and another end being a free end. The fixed end of the clenching member 31*a* and one of the front and back sides 221*a* and 222*a* of the engaging head respectively includes a hole 313*a* and an engaging hole 24*a*, and the first fastener 28 inserts into the hole 313*a* and the engaging hole 24*a* and fastens the clenching member 31*a* on the engaging head. The clenching member 31*a* has a main body 311*a* and includes a lever 312*a* protruding upwardly from the main body 311*a*. The lever 312*a* facilitates the operation of the clenching member 31. The clenching member 31*a* is resilient. The clenching member 31*a* is formed by bending a metal plate to form an integral structure. The clenching member 31*a* includes a middle portion 314*a* between the fixed end and the free end. The middle portion 314*a* and fixed and free ends, in a lateral direction, each have a cross-sectional area, and the cross-sectional area of the middle portion 314*a* is smaller than the cross-sectional areas of the respective fixed and free ends. The middle portion 314*a* lies in a reference plane P that is perpendicular to the axis L. The middle portion 314*a* includes a first curved portion 3141*a* and a second curved portion 3142*a*. A center of curvature of the first curved portion 3141*a* and a center of curvature of the second curved portion 3142*a* are respectively located on two opposite sides of the middle portion 314*a*. The center of curvature of the first curved portion 3141*a* is located on a side of the middle portion 314*a* that is adjacent to the engaging space 23*a*. The center of curvature of the second curved portion 3142*a* is located on another side of the middle portion 314*a* that is opposite to the engaging space 23*a*. The second curved portion 3142*a* is located between the first curved portion 3141*a* and the clenching portion. An average radius of curvature of the first curved portion 3141*a* is set as a first radius R1. An average radius of curvature of the second curved portion 3142*a* is set as a second radius R2. The second radius R2 is larger than the first radius R1. In this embodiment, the second radius R2 is larger than 1.5 times the first radius R1 and is smaller than 2 times the first radius R1. The clenching member 31*a* includes a clenching portion and is operable in a first mode in which the clenching portion is located at a first position and capable of clenching the object received by the engaging space 23*a*, and a second mode in which the clenching portion is located at a second position and disposed away from the engaging space 23*a* and capable of letting the object engaged with the engaging head disengage therefrom. The clenching portion is at the first position when the clenching member 31 is not operated. The clenching portion is located at the free end of the clenching member 31*a*. The clenching portion has an outer edge forming a sloped guiding edge 3111*a*. The sloped guiding edge 3111 has a lower end and an upper end and extends from the lower end to the upper end in a slanting direction that facilitates the insertion of the object into the engaging space 23*a*. The slopped guiding edge 3111*a* is neither parallel nor perpendicular to the axis L. A limiting protrusion 315*a* protrudes from a side of the clenching portion. The limiting protrusion 315*a* is movably received in the limiting groove 223*a* relative to the structure 20*a* in response to the operation of the clenching member 31*a*. When the clenching portion is located at the second position, the limiting protrusion 315*a* is stopped moving out of the limiting groove 223*a* by the limiting portion 224*a*.

In view of the forgoing, because the clenching members 31 and 31*a* are resilient, the clenching portions are adapted to be moved to the first and second positions, and when the clenching portions are located at the respective first positions thereof they can clench and prevent disengagement of the socket 90 from the clench wrenches 10 and 10*a*, and when the clenching portions are located at the respective second positions thereof the sockets 90 can disengage from the clench wrenches 10 and 10*a*.

The foregoing is merely illustrative of the principles of this invention and various modifications can be made by those skilled in the art without departing from the scope and spirit of the invention.

What is claimed is:

1. A clench wrench comprising:

a structure including a first body defining a handle for a user to grasp and a second body defining an engaging head for engaging with an object to be clenched respectively, wherein the engaging head includes an engaging space for receiving the object engaged with and to be driven by the clench wrench, wherein the engaging head has two opposite sides with one side defining a front side and the other side defining a back side respectively and includes the engaging space extending through the front and back sides and defining an opening in each of the front and back sides; and a clenching member having a first end being a fixed end fixed to the engaging head and a second end being a free end and having a clenching portion configured for clenching the object, wherein the clenching member is resilient such that the clenching portion is operable in a first mode in which the clenching portion is located at a first position and configured to clench the object received by the engaging space, and a second mode in which the clenching portion is disposed away from the engaging space and is located at a second position and configured to let the object engaged with the engaging head disengage therefrom;

wherein the clenching member has a middle portion between the fixed end and the free end, and wherein the middle portion and fixed and free ends, in a lateral direction, each have a cross-sectional area, and the cross-sectional area of the middle portion is smaller than the cross-sectional areas of the respective fixed and free ends; and wherein the middle portion includes a first curved portion and a second curved portion, wherein a center of curvature of the first curved portion and a center of curvature of the second curved portion are respectively located on two opposite sides of the middle portion, wherein the center of curvature of the first curved portion is located on a side of the middle portion that is adjacent to the engaging space, wherein the center of curvature of the second curved portion is located on another side of the middle portion that is opposite to the engaging space, and wherein the second curved portion is located between the first curved portion and the clenching portion.

2. The clench wrench as claimed in claim 1, wherein the clenching member is disposed on one of the front and back sides of the engaging head, and wherein the clenching portion is located at the free end of the clenching member.

3. The clench wrench as claimed in claim 2, wherein the fixed end of the clenching member and one of the front and back sides of the engaging head respectively includes a hole and an engaging hole, and a first fastener inserts into the hole and the engaging hole and fastens the clenching member on the engaging head.

4. The clench wrench as claimed in claim 1, wherein an average radius of curvature of the first curved portion is set as a first radius and an average radius of curvature of the second curved portion is set as a second radius respectively, and wherein the second radius is larger than the first radius.

5. The clench wrench as claimed in claim 4, wherein the second radius is larger than 1.5 times the first radius and is smaller than 2 times the first radius.

6. The clench wrench as claimed in claim 5, wherein the clenching portion of the clenching member has an outer edge forming a sloped guiding edge configured to facilitate the insertion of the object into the engaging space.

7. The clench wrench as claimed in claim 1, wherein the structure includes a limiting groove in the engaging head and a side of the limiting groove includes a limiting portion, wherein the clenching member includes a limiting protrusion protruding from a side of the clenching portion, and wherein the limiting protrusion is movably received in the limiting groove relative to the structure in response to the operation of the clenching member, and wherein when the clenching portion is located at the second position the limiting protrusion is stopped from moving out of the limiting groove by the limiting portion.

8. The clench wrench as claimed in claim 1, wherein the clenching member is a metallic member.

9. The clench wrench as claimed in claim 1, wherein the engaging space is defined by an inner periphery of a ratchet wheel, wherein the ratchet wheel is rotatably engaged with the engaging head and has a center of rotation about an axis, and wherein the axis extends in a thickness direction of the engaging head.

10. The clench wrench as claimed in claim 9 further comprising a switch device interacted with the ratchet wheel and configured to releasably stop the ratchet wheel from rotation, and wherein the switch device includes an input control exposed from the engaging head.

11. The clench wrench as claimed in claim 1, wherein the clenching member is a thin plate that has a substantially smaller thickness than a thickness of the engaging head.

12. The clench wrench as claimed in claim 1, wherein the engaging head includes a wall disposed above and shielding the clenching member.

13. The clench wrench as claimed in claim 1, wherein the clenching member has a main body and includes a lever protruding upwardly from the main body.

* * * * *